US009972410B2

(12) United States Patent
Han et al.

(10) Patent No.: US 9,972,410 B2
(45) Date of Patent: May 15, 2018

(54) TI-INCLUDED OXIDE DISPERSION STRENGTHENED COPPER ALLOY AND METHOD FOR MANUFACTURING DISPERSED COPPER

(71) Applicants: KOREA INSTITUTE OF MACHINERY & MATERIALS, Daejeon (KR); GLOBAL FRONTIER HYBRID INTERFACE MATERIALS, Geumjeong-gu, Busan (KR)

(72) Inventors: Seung Zeon Han, Changwon-si (KR); Hong Rae Joh, Changwon-si (KR); Jee Hyuk Ahn, Changwon-si (KR); Kwang Ho Kim, Busan (KR)

(73) Assignees: KOREA INSTITUTE OF MACHINERY & MATERIALS, Daejeon (KR); GLOBAL FRONTIER HYBRID INTERFACE MATERIALS, Busan (KR)

( * ) Notice: Subject to any disclaimer, the term of this patent is extended or adjusted under 35 U.S.C. 154(b) by 446 days.

(21) Appl. No.: 14/694,969

(22) Filed: Apr. 23, 2015

(65) Prior Publication Data

US 2016/0189820 A1 Jun. 30, 2016

(30) Foreign Application Priority Data

Dec. 26, 2014 (KR) ..... 10-2014-0191034

(51) Int. Cl.

| | |
|---|---|
| ***C22C 9/00*** | (2006.01) |
| ***H01B 1/02*** | (2006.01) |
| ***B22D 21/02*** | (2006.01) |
| ***C22C 9/01*** | (2006.01) |
| ***C22C 9/06*** | (2006.01) |

(52) U.S. Cl.

CPC ..... *H01B 1/026* (2013.01); *B22D 21/025* (2013.01); *C22C 9/00* (2013.01); *C22C 9/01* (2013.01); *C22C 9/06* (2013.01)

(58) Field of Classification Search

CPC ..... B22D 21/025; B22D 27/026; C22C 9/00; C22C 9/01; C22C 9/06; H01B 1/026

See application file for complete search history.

(56) References Cited

U.S. PATENT DOCUMENTS 5,004,498 A * 4/1991 Shimamura ..... B23K 35/222 257/E39.017
2010/0189593 A1* 7/2010 Maehara ..... C22C 9/00 420/473

FOREIGN PATENT DOCUMENTS

| | | |
|---|---|---|
| JP | 60-131903 A | 7/1985 |
| JP | 11-286702 | 10/1999 |
| KR | 10-2006-0094217 A | 8/2006 |

OTHER PUBLICATIONS

Korean Intellectual Property Office. Korean Office Action dated Dec. 18, 2015. Korean Patent Application No. 10-2014-0191034. Korean Language. 7 pages.

Joh, Hong Rae et al. "Effect of Ti addition to and internal oxidation conditions of $Al_2O_3$ dispersion copper on mechanical and electrical property", 2014 Spring Conference of the Korean Institute of Metals and Materials, Apr. 24, 2014. Korean and English Language Translation. 4 pages.

Joh, Hong Rae et al. "Improvement of properties of $Al_2O_3$dispersion copper through control of shape and size of dispersion phase." 2014 Spring Conference of the Korean Institute of Metals and Materials. Oct. 22, 2014. Korean and English Language Translation. 4 pages.

Han, Seung Zeon et al. "Simultaneous increasing strength and conductivity of dispersed copper matrix composite fabricated by internal oxidation in ambient atmosphere". $54^{th}$ Conference of the Japanese Institute of Metals. Nov. 8, 2014. Korean and English Language Translation. 4 pages.

* cited by examiner

*Primary Examiner* — Jessee R Roe
(74) *Attorney, Agent, or Firm* — Moore & Van Allen PLLC; Henry B. Ward, III

(57) ABSTRACT

The present invention relates to a Ti-included oxide dispersion strengthened copper alloy and a method for preparing oxide dispersion copper by an internal oxidation Ti-included copper alloy, which thus allows spheronization and refinement of the oxides, and reduction of distance between the oxides. According to the present invention, there is provided oxide dispersion copper having excellent hardness and tensile strength as well as electrical conductivity by performing spheronization and refinement for Ti-included oxide and thus further reducing the distance between oxides.

13 Claims, 23 Drawing Sheets
(20 of 23 Drawing Sheet(s) Filed in Color)

Comparative Example 1

Example 1

TI-INCLUDED OXIDE DISPERSION STRENGTHENED COPPER ALLOY AND METHOD FOR MANUFACTURING DISPERSED COPPER

CROSS REFERENCE TO RELATED APPLICATION

This application claims the benefit of Korean Patent Application No. 10-2014-0191034, filed on Dec. 26, 2014, entitled "Ti-included oxide dispersion strengthened copper alloy and method for manufacturing dispersed copper", which is hereby incorporated by reference in its entirety into this application.

BACKGROUND OF THE INVENTION

1. Technical Field

The present invention relates to a Ti-included oxide dispersion strengthened copper alloy and a method for manufacturing the same. More particularly, the present invention relates to a Ti-included oxide dispersion strengthened copper alloy and a method for manufacturing titanium included oxide dispersion copper having improved electrical conductivity as well as hardness and strength through spheroidization of oxides in a copper base and reduction of an average particle size by an internal oxidation.

2. Description of the Related Art

A copper-based oxide dispersion strengthened copper alloy is an alloy having improved strength, wear-resistant and electrical conductivity by dispersing alumina in a copper base. According to metal strengthening mechanisms, when size or radius of an oxide is small and a distance between oxides is reduced in an identical volume fraction, strength and hardness are improved while maintaining electrical conductivity. Reducing an oxide size and a distance between oxides in an identical volume in the copper base is a way to improve strength and wear-resistant of a copper-based oxide dispersion strengthened copper alloy while maintaining electrical conductivity.

The copper-based oxide dispersion strengthened copper alloy is mainly used as an electrode material, an electrical contact material for resistance welding, and a connector. In case of a copper alloy, it requires materials having both mechanical properties including strength and electrical conductivity. In the resistance welding, high conductivity and thermal durability become more important. Oxide dispersion copper has been used in a variety of high temperature electrical materials due to its excellent electrical properties, mechanical properties and heat resistance at a high temperature. Here, the oxide dispersion copper is generally prepared by an internal oxidation.

The internal oxidation is a metal strengthening method which forms a fine dispersion phase within the alloy by diffusion of oxygen from the surface of the alloy only to oxidize solute in the alloy. In the past, powder metallurgy is used in order to shorten heat treatment time for the internal oxidation. Powder metallurgy is the process for preparing a desired oxide dispersion copper alloy through manufacturing copper-aluminum alloy powder, internal oxidation, sintering, hot extrusion and cold rolling.

KR Patent Publication No. 10-2006-0094217 (Aug. 29, 2006) discloses aluminum oxide dispersion strengthened copper alloy powder and a method for manufacturing the same.

PRIOR ART

KR Patent Publication No. 10-2006-0094217 (Aug. 29, 2006)

SUMMARY OF THE INVENTION

An object of the present invention is to provide titanium-included oxide dispersion copper having improved electrical conductivity as well as hardness and strength.

Another object of the present invention is to provide a Ti-included oxide dispersion strengthened copper alloy which is able to generate various oxides through combined addition of metal components such as aluminum, titanium, nickel, iron and the like by using a method for generating an oxide in an alloy and spheroidize the oxides through metal component-included oxides to reduce average particle radius and increase particle distribution.

Further another object of the present invention is to provide oxide dispersion copper having improved electrical conductivity as well as hardness and strength through an internal oxidation by using the Ti-included oxide dispersion strengthened copper alloy.

Further another object of the present invention is to provide a method for manufacturing oxide dispersion copper which effectively manufactures a titanium oxide dispersion copper alloy having improved electrical conductivity as well as hardness and strength by utilizing refinement, spheroidization, and uniform dispersion of oxides.

Further another object of the present invention is to provide plate, wire and powder alloy having improved refinement, spheroidization, and dispersion of oxides.

Further another object of the present invention is to provide a raw material for internal oxidation which can prepare plate, wire and powder alloy having improved refinement, spheroidization, and dispersion of the oxides.

The above and other objects, features and advantages of the present invention will become more apparent to those of ordinary skill in the art by describing in detail exemplary embodiments thereof with reference to the accompanying drawings.

DESCRIPTION OF THE EXEMPLARY EMBODIMENTS

According to an aspect of the present invention, there is provided oxide dispersion copper wherein at least one metal oxide selected from the group consisting of Ti-doped aluminum oxide, aluminum titanium oxide, iron titanium oxide, nickel titanium oxide and iron nickel titanium oxide is dispersed in copper or copper alloy.

According to another aspect of the present invention, there is provided a Ti-included copper alloy including one or more metals selected from the group consisting of aluminum, nickel, iron, chromium, vanadium, zirconium, manganese, cobalt, zinc, iridium, molybdenum and an alloy thereof which forms a metal oxide in copper or copper alloy in order to provide an oxide dispersion strengthened copper alloy by the oxidation.

According to another aspect of the present invention, there is provide metal oxide-dispersed oxide dispersion copper which is prepared by oxidizing an oxide dispersion strengthened copper alloy of the present invention through oxygen diffusion and oxidation.

According to further another aspect of the present invention, there is provided a method for preparing oxide dispersion copper including: casting a oxide dispersion strengthened copper alloy of the present invention; and oxidizing the copper alloy by reacting with oxygen under oxygen supply.

According to further another aspect of the present invention, there is provide a $Cu_2O$ oxidizing agent including at least one selected from the group consisting of Al, Ti, Ni and Fe which is prepared as an oxidation layer eliminated from the surface of an oxide dispersion copper which is oxidation-treated by the method for preparing oxide dispersion copper of the present invention.

According to further another aspect of the present invention, there is provide an electrode material, a wear-resistant coating layer, or a small wear-resistant material which is prepared by using the oxide dispersion copper of the present invention.

According to an embodiment of the present invention, there may be provided titanium-included oxide dispersion copper having improved electrical conductivity as well as hardness and strength.

According to an embodiment of the present invention, there may be provided a Ti-included oxide dispersion strengthened copper alloy for preparing oxide dispersion copper which uses a method for generating oxide inside an alloy, generates various oxides through combined addition of metal components such as aluminum, titanium, nickel, iron and the like, spheroidizes the oxides through metal component-doped oxides, reduces average particle size, and increase particle distribution.

According to an embodiment of the present invention, there may be provided a copper alloy in which Ti-doped aluminum oxide, or titanium oxide, or nickel or iron-included oxide is dispersed by the internal oxidation.

According to an embodiment of the present invention, there may be provided oxide dispersion copper of which dispersion phase has uniform size, small average particle size, and a sphere shape by the internal oxidation of Ti-included oxide dispersion strengthened copper alloy. According to the present invention, electrical conductivity as well as hardness and strength of the oxide dispersion copper can be thus improved.

According to an embodiment of the present invention, there may be provided a material alloy for the internal oxidation in order to prepare a high temperature electrical material, a wear-resistant coating layer, and a small wear-resistant material having high conductivity and high strength.

According to an embodiment of the present invention, there may be effectively prepared oxide dispersion copper having improved electrical conductivity as well as hardness and strength through refinement, spheroidization, and uniform dispersion of the oxide.

BRIEF DESCRIPTION OF DRAWING

The patent or patent application file contains at least one drawing executed in color. Copies of this patent or patent application publication with color drawing(s) will be provided by the Office upon request and payment of the necessary fee.

DESCRIPTION OF THE EXEMPLARY EMBODIMENTS

Figure 1:
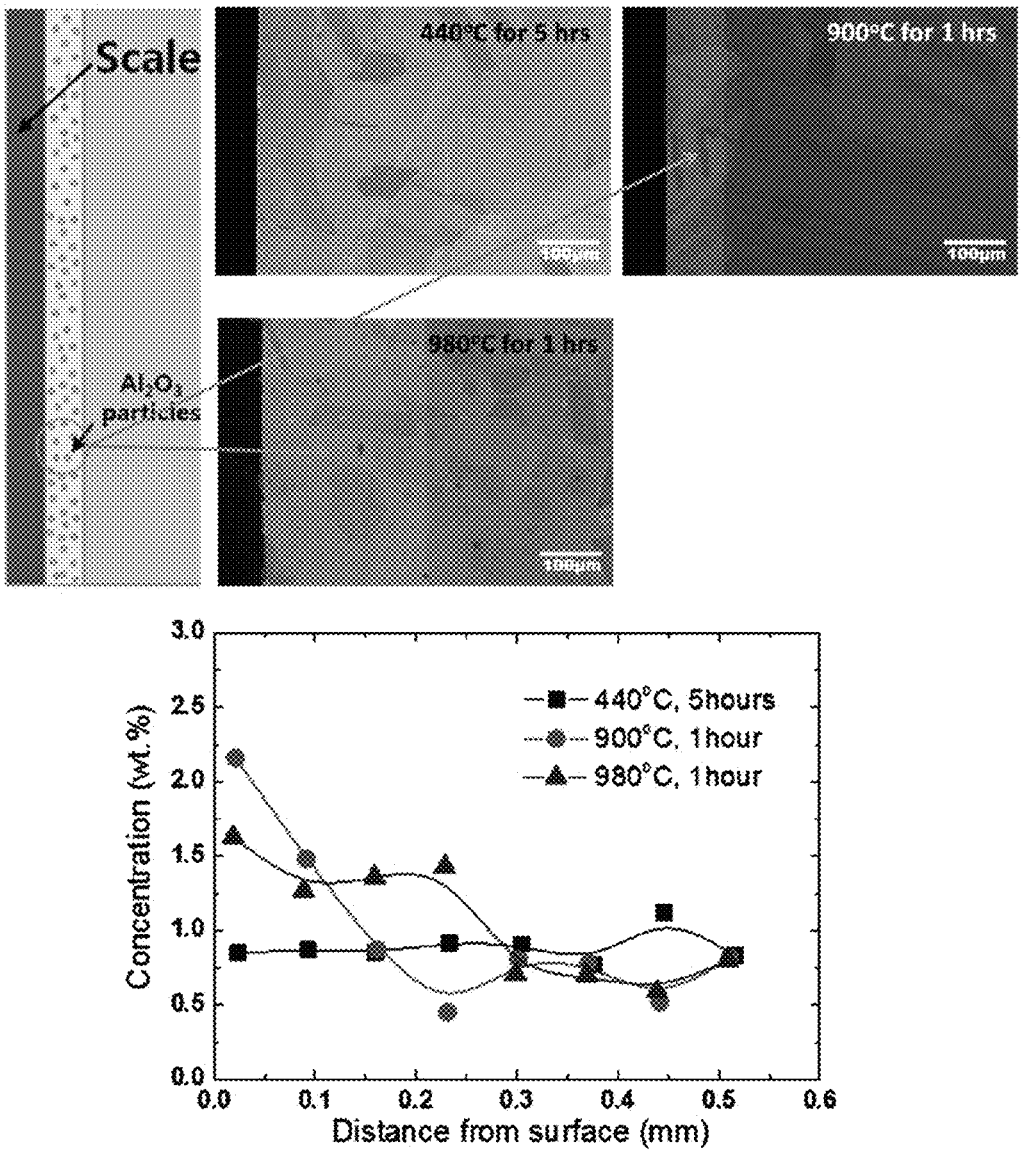
FIG. 1 is SEM image illustrating thickness of an oxidation layer (scale) of a copper-aluminum-titanium alloy of the present invention according to the oxidation treatment temperature and a graph of oxygen concentration vs distance from the alloy surface.

Hereinafter, although more detailed descriptions will be given by examples, those are only for explanation and there is no intention to limit the invention.

While the present invention has been described with reference to particular embodiments, it is to be appreciated that various changes and modifications may be made by those skilled in the art without departing from the spirit and scope of the present invention, as defined by the appended claims and their equivalents. Throughout the description of the present invention, when describing a certain technology is determined to evade the point of the present invention, the pertinent detailed description will be omitted.

While such terms as "first" and "second," etc., may be used to describe various components, such components must not be limited to the above terms. The above terms are used only to distinguish one component from another.

The terms used in the description are intended to describe certain embodiments only, and shall by no means restrict the present invention. Unless clearly used otherwise, expressions in the singular number include a plural meaning. In the present description, an expression such as "comprising" or "consisting of" is intended to designate a characteristic, a number, a step, an operation, an element, a part or combinations thereof, and shall not be construed to preclude any presence or possibility of one or more other characteristics, numbers, steps, operations, elements, parts or combinations thereof.

According to an aspect of the present invention, there is provided oxide dispersion copper wherein at least one metal oxide selected from the group consisting of Ti-doped aluminum oxide, aluminum titanium oxide, iron titanium oxide, nickel titanium oxide and iron nickel titanium oxide is dispersed in copper or copper alloy.

The oxide dispersion copper including titanium-included metal oxide of the present invention is determined to have improved electrical conductivity as well as hardness and strength due to dispersion of titanium oxide inside the copper or copper alloy.

The titanium-included metal oxide of the present invention may be included inside the copper or copper alloy after being prepared by various manufacturing methods but it is not limited thereto. A particular method for preparing a dispersion copper alloy may be any known method for preparing an alloy.

According to an embodiment of the present invention, the metal oxide may include at least one metal oxide chosen from Ti-doped $Al_2O_3$, $Al_3Ti_5O_2$, $TiO_2$, $Fe_2TiO_4$, $FeTiO_3$, $NiTiO_3$, and (Fe, Ni)$TiO_3$ and preferably $TiO_2$, but it is not limited thereto.

According to an embodiment of the present invention, the dispersion copper is in the form of plate, wire, or powder.

The metal oxide may further include at least one metal chosen from chromium, vanadium, zirconium, manganese, cobalt, zinc, iridium, molybdenum and an alloy thereof but it is not limited thereto.

According to another aspect of the present invention, a Ti-included copper alloy is provided in which the Ti-included copper alloy includes at least one chosen from aluminum, nickel, iron, chromium, vanadium, zirconium, manganese, cobalt, zinc, iridium, molybdenum and an alloy thereof which forms a metal oxide inside copper or copper alloy to provide an oxide dispersion strengthened copper alloy through the oxidation.

In the present invention, titanium is added to a copper alloy to allow oxygen to be pack cemented inside the alloy to cause oxidation reaction so that the generated oxide can be spheroidized, refined and uniformly dispersed in the copper alloy base to improve hardness, tensile strength and electrical conductivity of the oxide dispersion copper.

According to the present invention, composition of the copper alloy including titanium may be controlled based on oxidation temperature and duration to a range that can be oxidized to the best.

According to an embodiment of the present invention, the titanium may be added by 0.06 parts by weight or more with reference to 100 parts by weight of the total alloy but it is not limited thereto. Content of the titanium in the alloy may be 0.06-0.5 parts by weight but it is not limited thereto to improve hardness, tensile strength and electrical conductivity with balance.

According to the present invention, the metal may include at least one transition metal chosen from aluminum, nickel, iron, chromium, vanadium, zirconium, manganese, cobalt, zinc, iridium, molybdenum and an alloy thereof which can generate various oxides easily through the internal oxidation but it is not limited thereto.

According to an embodiment of the present invention, x/(x+y) of the titanium weight x and the metal weight except copper y may be 0.125 or more but it is not limited thereto. Thus, hardness, tensile strength and electrical conductivity may be improved with balance. The titanium may be added in an amount of 14% or more in a metal weight-to-weight ratio, except titanium/copper, but it is not limited thereto.

According to an embodiment of the present invention, the metal may be aluminum which may be added to be 0.2 parts by weight or more of a titanium/aluminum ratio but it is not limited thereto. Titanium may be also added to be 0.2-1.0 parts by weight to the content of aluminum. Here, hardness, tensile strength and electrical conductivity may be thus improved with balance. When titanium to be added in the copper-aluminum alloy is 0.2 weight % or more compared to aluminum, dispersion phase of the oxide dispersion copper effectively increases from a rod or rectangle shape to a sphere shape, but it is not limited thereto.

The aluminum content of the alloy may be 0.2-0.8 parts by weight but it is not limited thereto. Thus, hardness, tensile strength and electrical conductivity thereof may be improved with balance.

The alloy may be composed of 0.06-0.5 parts by weight titanium, 0.2-0.8 parts by weight aluminum, the balance copper and other incidental impurities in 100 parts by weight of the alloy, but it is not limited thereto.

According to an embodiment of the present invention, the copper alloy may be in the form of plate, wire, or powder.

The copper alloy may be in the form of wire or plate. When it is in the form of wire or plate, efficiency of the internal oxidation may be increased during preparing the oxide dispersion copper and processing efficiency may be also increased during processing the prepared oxide dispersion copper to an electrode material, but it is not limited thereto. Particularly, since titanium is added in a copper alloy in the present invention, even though the copper alloy in bulk quantities is heat-treated in the present invention, the internal oxidation can be carried effectively and scale of the result can be small. Accordingly, the alloy of the present invention may increase production efficiency and reduce production cost during preparing the oxide dispersion copper.

Thickness of the copper alloy may vary with heat treatment conditions for the internal oxidation to prepare oxide dispersion copper from a wire- or plate-typed alloy but it is not limited thereto. When the oxide dispersion copper which is thus prepared from the wire- or plate-typed alloy is processed to an electrode material, it may increase processing efficiency and reduce production cost. Thickness of the copper alloy may be 0.01-0.6 mm but it is not limited thereto. According to the present invention, since the internal oxidation is carried effectively within about 0.2-0.3 mm from the surface of a copper alloy when titanium is added in the copper alloy, both sides of the alloy can be heat-treated by controlling thickness of the alloy to let the entire alloy be produced as oxide dispersion copper.

According to another aspect of the present invention, there is provided metal oxide-dispersed oxide dispersion copper which is prepared by oxygen diffusion and oxidation of the copper alloy of the present invention.

According to an embodiment of the present invention, the metal oxide may include at least one metal oxide chosen from Ti-doped aluminum oxide, aluminum titanium oxide, titanium oxide, iron titanium oxide, nickel titanium oxide and iron nickel titanium oxide.

Oxides may be reinforced aluminum titanium oxide, nickel titanium oxide, iron titanium oxide, or nickel iron titanium oxide by the internal oxidation but it is not limited thereto.

Raw material alloy, which is used to prepare the aluminum titanium oxide, nickel titanium oxide, iron titanium oxide or nickel iron titanium oxide by the oxidation, may be in the form of wire, plate or powder but it is not limited thereto.

The metal oxide may include at least one metal oxide chosen from Ti-doped $Al_2O_3$, $Al_3Ti_5O_2$, $TiO_2$, $Fe_2TiO_4$, $FeTiO_3$, $NiTiO_3$, and (Fe, Ni)$TiO_3$ and preferably $TiO_2$, but it is not limited thereto.

According to an embodiment of the present invention, dispersion phase of the oxide dispersion copper prepared by the present invention is a sphere shape but it is not limited thereto. When titanium is added in an amount of 0.2 weight % or more, compared to aluminum, in the copper-aluminum alloy, the dispersion phase shape of the oxide dispersion copper can be more efficiently from a rod or rectangle shape to a sphere shape but it is not limited thereto.

The higher titanium weight % ratio to aluminum is, the smaller and more uniform average particle size of dispersion phase of the oxide dispersion copper prepared in the present invention becomes. Average particle size of the dispersion phase of the oxide dispersion copper prepared in the present invention is 15-35 nm but it is not limited thereto. However, average particle size of the dispersion phase of the copper-aluminum alloy which does not include titanium is about 60 nm.

The higher titanium weight % ratio to aluminum is, the higher linear density of the dispersion phase of the oxide dispersion copper prepared in the present invention becomes. Average linear density of the dispersion phase of the oxide dispersion copper prepared in the present invention is $6.00\times10^9/cm^3$-$1.40\times10^{10}/cm^3$, but it is not limited thereto. However, density of the dispersion phase of the copper-aluminum alloy which does not include titanium is about $1.75\times10^9/cm^3$.

According to further another aspect of the present invention, there is provided a method for preparing oxide dispersion copper including casting a copper alloy of the present invention; and oxidizing the copper alloy by reacting with oxygen under oxygen supply.

According to an embodiment of the present invention, the oxygen supply may be carried by atmospheric pressure, oxygen atmosphere, or an oxidizing agent. The internal oxidation in the present invention may be performed under atmosphere or oxygen atmosphere so that the process may be simplified compared to a conventional process, but it is not limited thereto. When it is performed under atmosphere, it does not require special or separate facilities or equipment which results in improvement of production efficiency and reduction of production cost. The internal oxidation under atmosphere may reduce a scale thickness.

According to an embodiment of the present invention, x/(x+y) of the titanium weight x and the metal weight except copper y may be 0.125 or more but it is not limited thereto. Thus, hardness, tensile strength and electrical conductivity may be improved with balance. The titanium may be added in an amount of 14% or more in a metal weight-to-weight ratio, except titanium/copper, but it is not limited thereto.

According to an embodiment of the present invention, the oxidation is heat treatment or plastic deformation, but it is not limited thereto.

The heat treatment may be performed at 900° C. or higher for 1 hour or more, but it is not limited thereto. When the heat treatment is performed under such conditions, efficiency of the internal oxidation is improved as well as electrical conductivity, hardness and tensile strength. On the other hand, when the heat treatment is performed at less than 900° C. or for less than 1 hour, efficiency of the internal oxidation is lowered. It is preferably performed at 980° C. for 1-4 hours but it is not limited thereto.

According to an embodiment of the present invention, the method may further include hot rolling of the cast copper alloy; cold rolling the hot rolled alloy; solution treating the cold rolled alloy; and cold rolling the solution treated alloy.

In an embodiment, the hot rolling is performed at 980° C. and 50% of reduction ratio but it is not limited thereto. Surface milling and the cold rolling is then performed at 50% of reduction ratio. The sides are trimmed and solution treated. The cold rolling is then performed with 0-92% and the internal oxidation is performed. Detailed description for the hot rolling and the cold rolling is omitted since the hot rolling and the cold rolling are performed by using a well-known method.

The oxidation layer (scale) of the heat-treated alloy is eliminated by mechanical polishing or chemical treatment to prepare the dispersion copper as an electrode material. When the heat treatment is performed to prepare alumina dispersion copper, 3 layers of a copper oxidation layer, an alumina generation layer, a no reaction layer are formed. Here, the copper oxidation layer is called as scale and can be eliminated by physical or chemical treatment and the alumina generation layer is separated to process as wire or plate to use as an electrode material or the like.

According to further another aspect of the present invention, there is provided a $Cu_2O$ oxidizing agent which is prepared as the oxidation layer which is eliminated from the surface of the oxide dispersion copper in the present invention and includes at least one chosen from Al, Ti, Ni and Fe. The oxidation layer (scale) which is eliminated from the surface of the oxide dispersion copper by mechanical polishing or chemical treatment in the present invention may be used as an oxidizing agent for oxygen supply since it includes alumina oxide, titanium oxide and the like as well as copper oxide.

According to further another aspect of the present invention, there is provided an electrode material, wear-resistant coating layer, or small wear-resistant material prepared by using the oxide dispersion copper including titanium. More particularly, the oxide dispersion copper of the present invention may be used to prepare an electrode material of resistance welding, an electrical contact material, a connector, a copper alloy tube, a heat transfer component, a high vacuum component, an accelerator component and the like. According to the present invention, a material having excellent hardness, tensile strength and electrical conductivity may be provided. The alloy of the present invention may be also used in all the fields which require high conductivity and high strength.

Ti-included oxide dispersion strengthened copper alloy and a method for preparing dispersion copper using the same will be described in more detail with reference to the accompanying drawings, in which those components are rendered the same reference number that are the same or are in correspondence, regardless of the figure number, and redundant explanations are omitted.

Figure 2A:
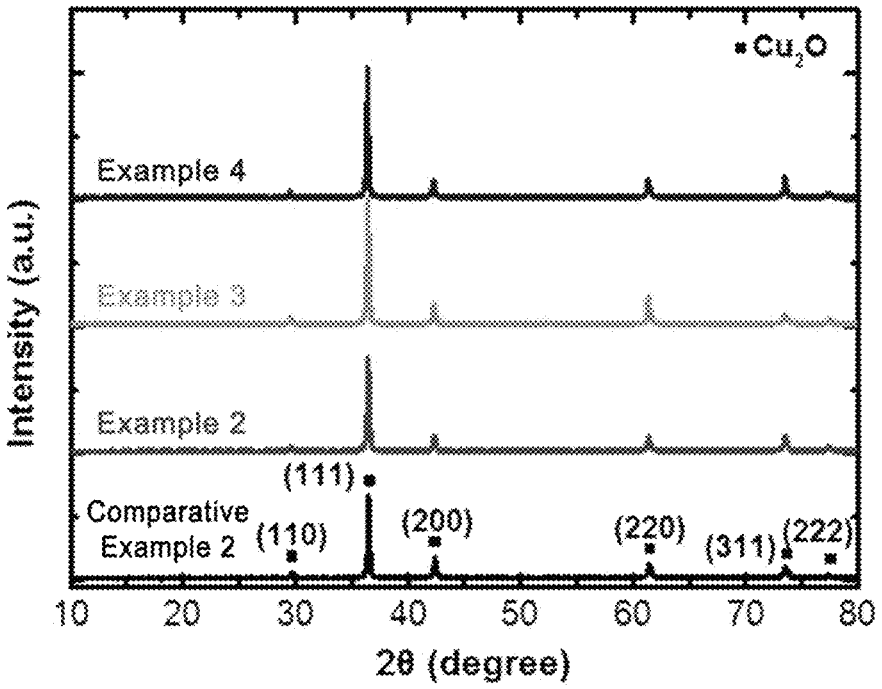
FIGS. 2A and 2B illustrate XRD analysis graphs of scale separated from the oxide dispersion copper after internal oxidation of the oxide dispersion copper which is prepared according to an embodiment of the present invention.
Figure 2B:
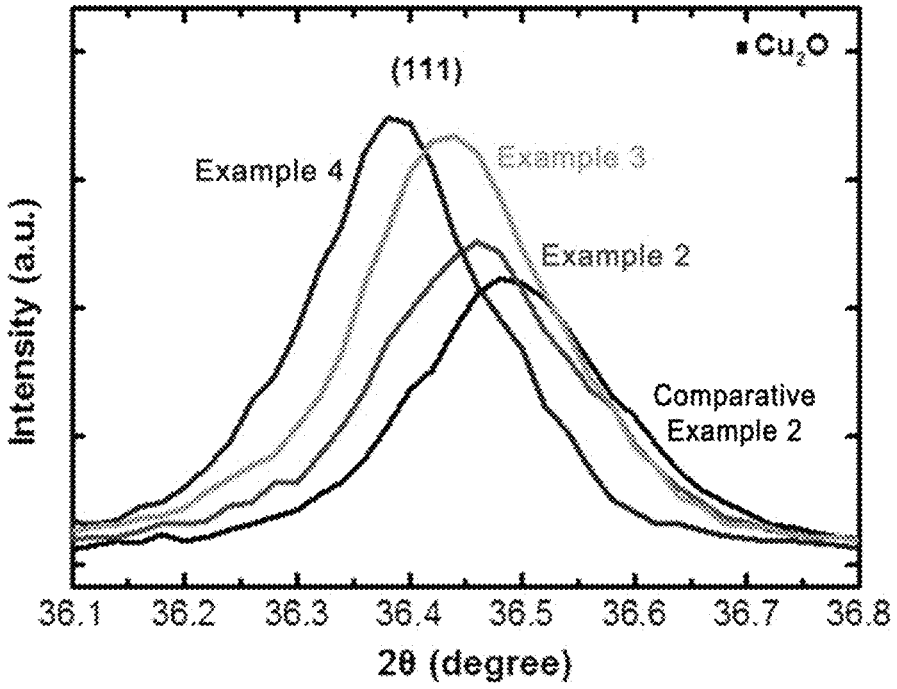

FIG. 1 is SEM image illustrating thickness of an oxidation layer (scale) of a copper-aluminum-titanium alloy of the present invention according to the oxidation treatment temperature and a graph of oxygen concentration vs distance from the alloy surface. FIG. 2 illustrates XRD analysis result (FIG. 2A) and analysis result of the (111) (FIG. 2B) surface after the internal oxidation of the alloys at 980° C. which are prepared according to Comparative Example 2 and Examples 2-4 in Table 1.

During the internal oxidation, the copper-aluminum-titanium alloy is divided into an oxide dispersion layer and a scale layer in which the dispersion layer can be prepared as wire, plate or powder type and the scale layer which includes a small amount of copper and titanium oxides can be used as an oxidizing agent.

Compositions of the copper-aluminum-titanium alloy used in Examples are shown in Table 1.

TABLE 1

| Alloy | Cu | Al | Ni | Fe | Ti | Ti weight/metal weight except copper (%) |
|---|---|---|---|---|---|---|
| Comparative Example 1 | Bal. | 0.3 | — | — | — | 0 |
| Comparative Example 2 | Bal. | 0.8 | — | — | — | 0 |
| Example 1 | Bal. | 0.28 | — | — | 0.065 | 18.8 |
| Example 2 | Bal. | 0.7 | — | — | 0.1 | 12.5 |
| Example 3 | Bal. | 0.4 | — | — | 0.4 | 50 |
| Example 4 | Bal. | 0.63 | — | — | 0.37 | 37 |
| Example 5 | Bal. | — | 0.52 | 0.18 | 0.2 | 22.2 |

Experimental Example 1. Analysis of Microstructure, Electrical and Mechanical Properties of Oxide Dispersion Copper of Example 1

FIG. 3 illustrates microstructure of the oxidation layer of the copper-aluminum alloy of Comparative Example 1 and the copper-aluminum-titanium alloy of Example 1.

As shown in FIG. 3, it is noted that the oxide of Example 1 which is a Ti-included copper-aluminum alloy has reduced particle size and distance between particles under the same oxidation condition, compared to that of Comparative Example 1.

Figure 3A:
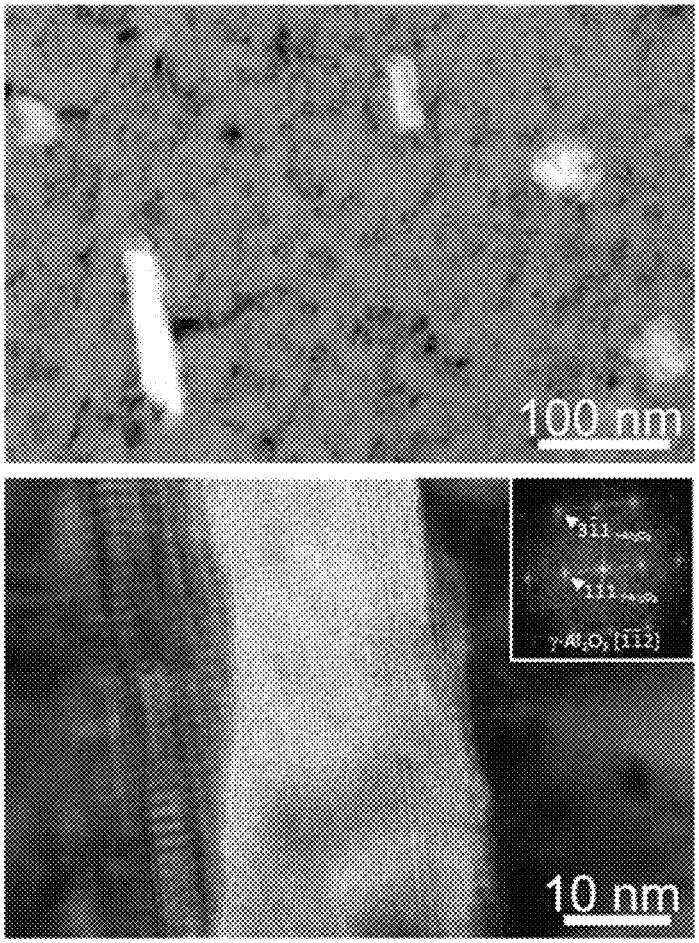
FIGS. 3A and 3B illustrate TEM images of shape, orientation relationship and composition of the dispersion phase of the oxide dispersion copper which is prepared according to an embodiment of the present invention.
Figure 3B:
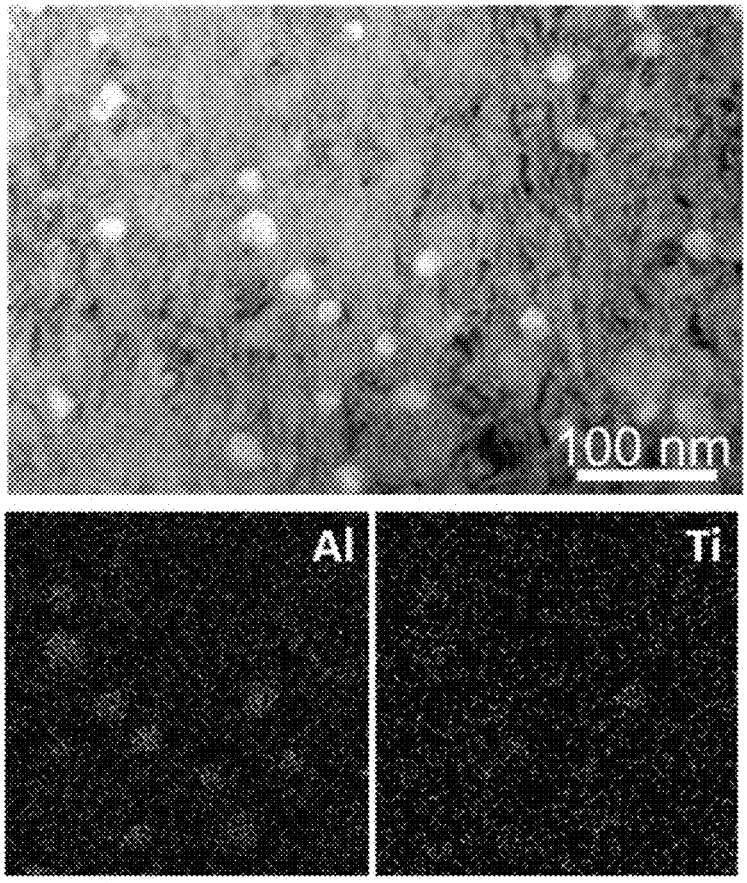

It is also noted in FIG. 3 that an average particle size of the dispersion phase of the oxide dispersion copper which is prepared in Comparative Example 1 (a copper-aluminum alloy which does not include titanium) is about 42 nm and an average particle size of the dispersion phase of the oxide dispersion copper in Example 1 is 23 nm and distribution is also more uniform. Particle shape of the oxide dispersion copper of Comparative Example 1 is a rod or rectangle shape (see FIG. 3A), while the shape of the dispersion phase of the oxide dispersion copper of Example 1 is a sphere shape (see FIG. 3B).

Figure 4A:
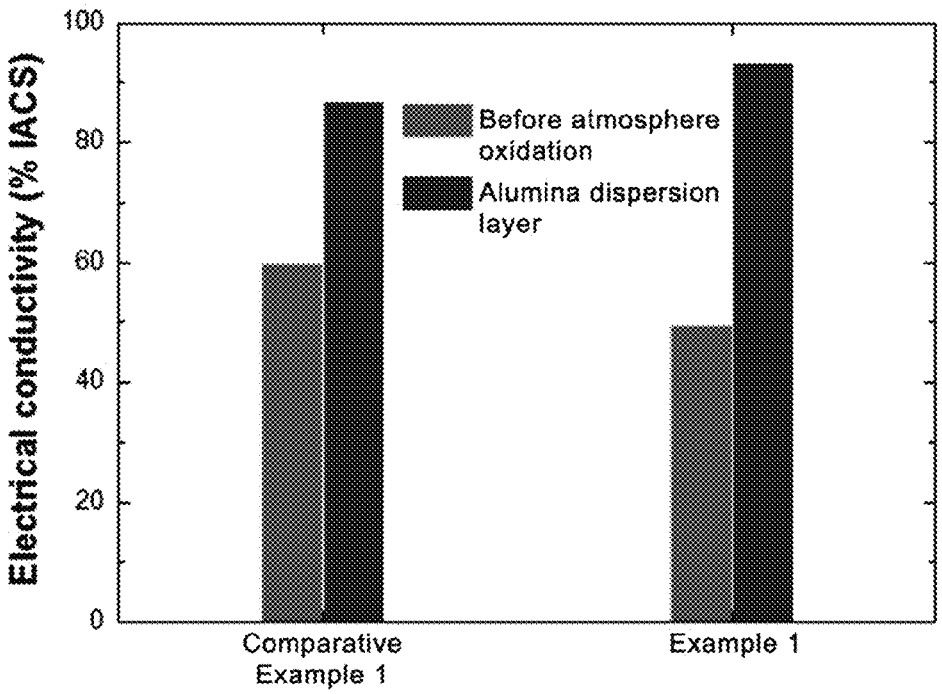
FIGS. 4A, 4B and 4C illustrate graphs of electrical conductivity, hardness, and tensile strength of the oxide dispersion copper which is prepared according to an embodiment of the present invention.
Figure 4B:
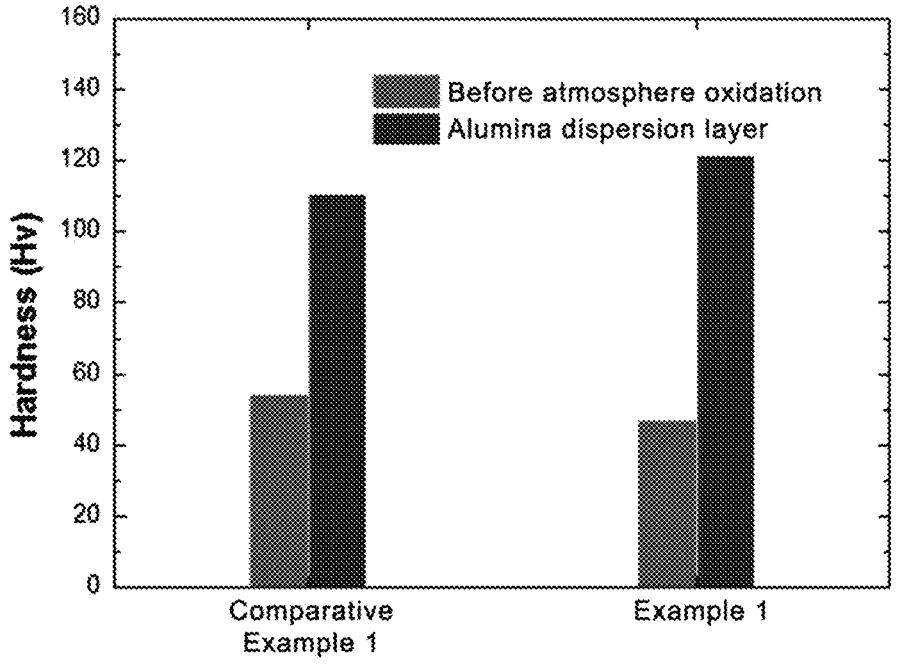
Figure 4C:
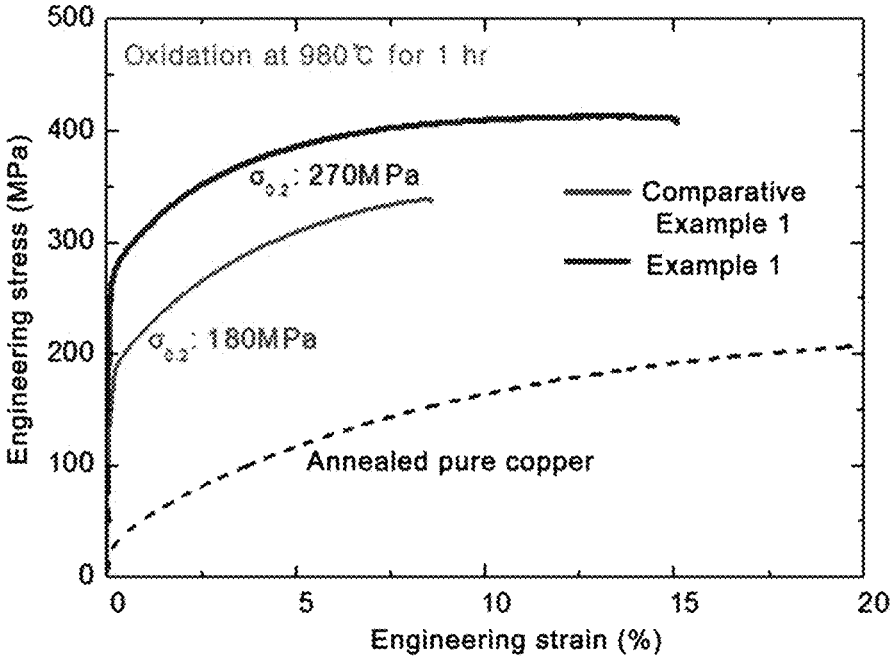

FIG. 4 illustrates graphs of electrical conductivity (FIG. 4A), hardness (FIG. 4B), and tensile strength (FIG. 4C) of the Copper-aluminum alloy of Comparative Example 1 and the Copper-aluminum-titanium alloy of Example 1 before and after the oxidation.

As shown in FIG. 4, it is noted that electrical conductivity, hardness, tensile strength, and strain to necking of the Ti-included copper-aluminum alloy of Example 1 is significantly higher than those of the copper-aluminum alloy of Comparative Example 1 after the oxidation. It proves that such properties of electrical conductivity, hardness, tensile strength, and strain to necking are increased because the oxide dispersion copper including titanium results in spheroidization, reduction of particle size and reduction of distance between particles, compared to that which does not include titanium prepared under the same condition.

Experimental Example 2. Analysis of Microstructure, Electrical and Mechanical Properties of the Oxide Dispersion Copper of Examples 2-4

Figure 5:
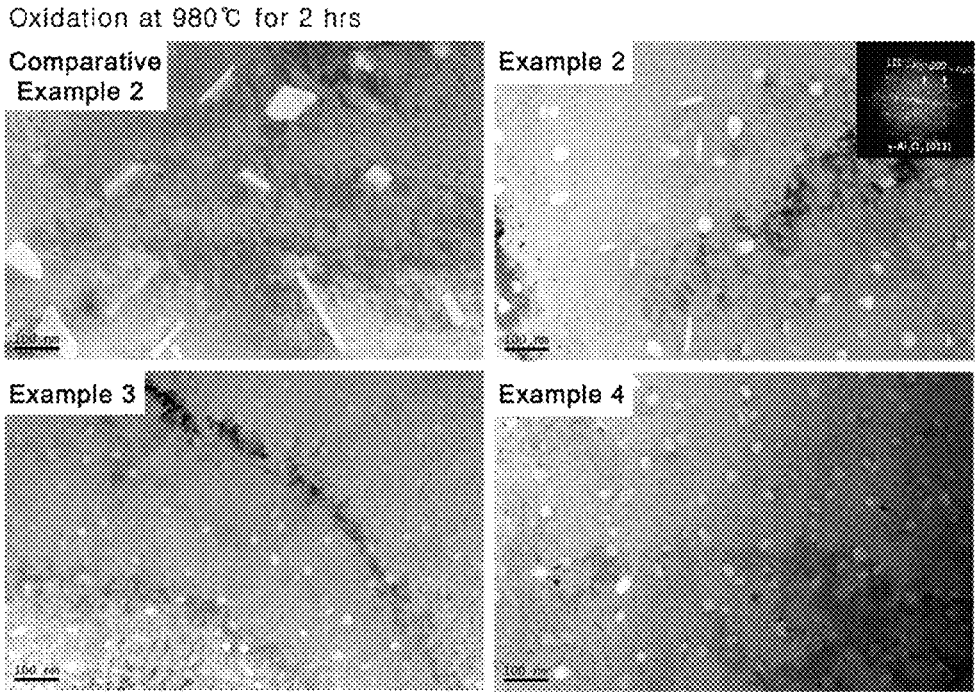
FIG. 5 illustrates TEM images of shape, orientation relationship and composition of the dispersion phase of the oxide dispersion copper which is prepared according to an embodiment of the present invention.

FIG. 5 illustrates microstructure of the dispersion phase of the oxide dispersion coppers which are prepared by the internal oxidation according to Comparative Example 2 and Examples 2-4. As shown in FIG. 5, it is noted that the more weight ratio of titanium is used, the more spheroidization of the oxide is made and the more the distance between particles is reduced.

Figure 6A:
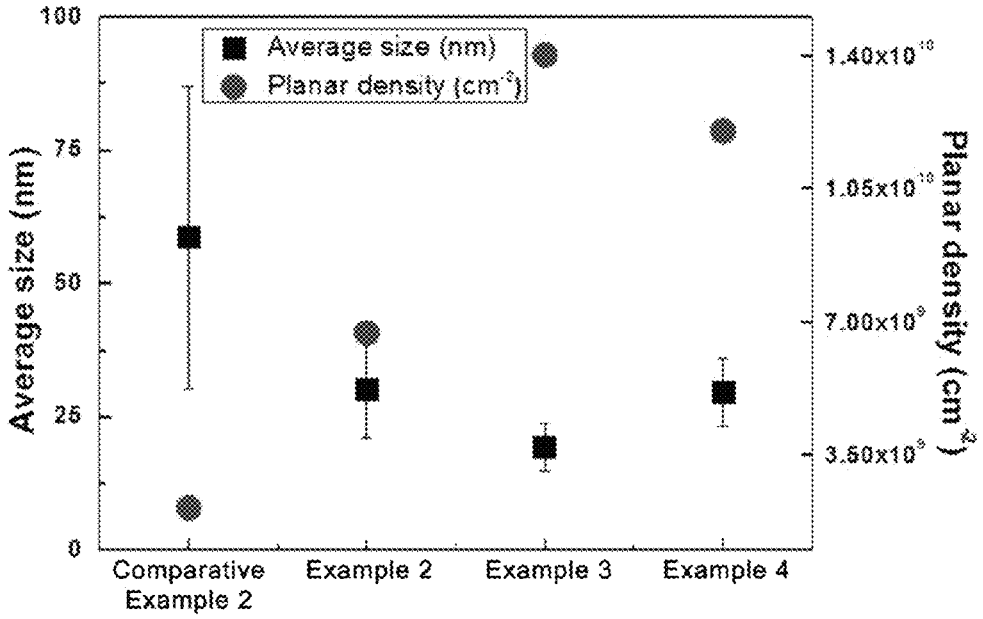
FIGS. 6A and 6B illustrate graphs of average particle size, density, and aspect ratio of the dispersion phase of the oxide dispersion copper which is prepared according to an embodiment of the present invention.
Figure 6B:
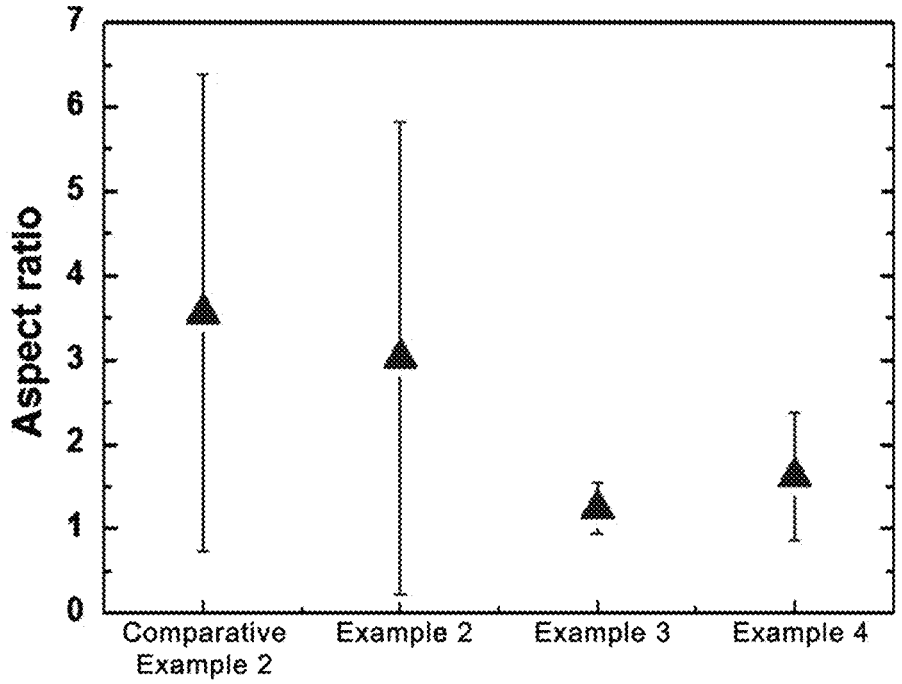

FIG. 6 illustrates graphs of average size, plane density (FIG. 6A), and aspect ratio (FIG. 6B) of the dispersion phase of the oxide dispersion coppers which are prepared by the internal oxidation according to Comparative Example 2 and Examples 2-4. As shown in FIG. 6, it is noted that the more weight ratio of titanium is used, the more spheronization of the oxide is made and the more the distance between particles is reduced.

Figure 7A:
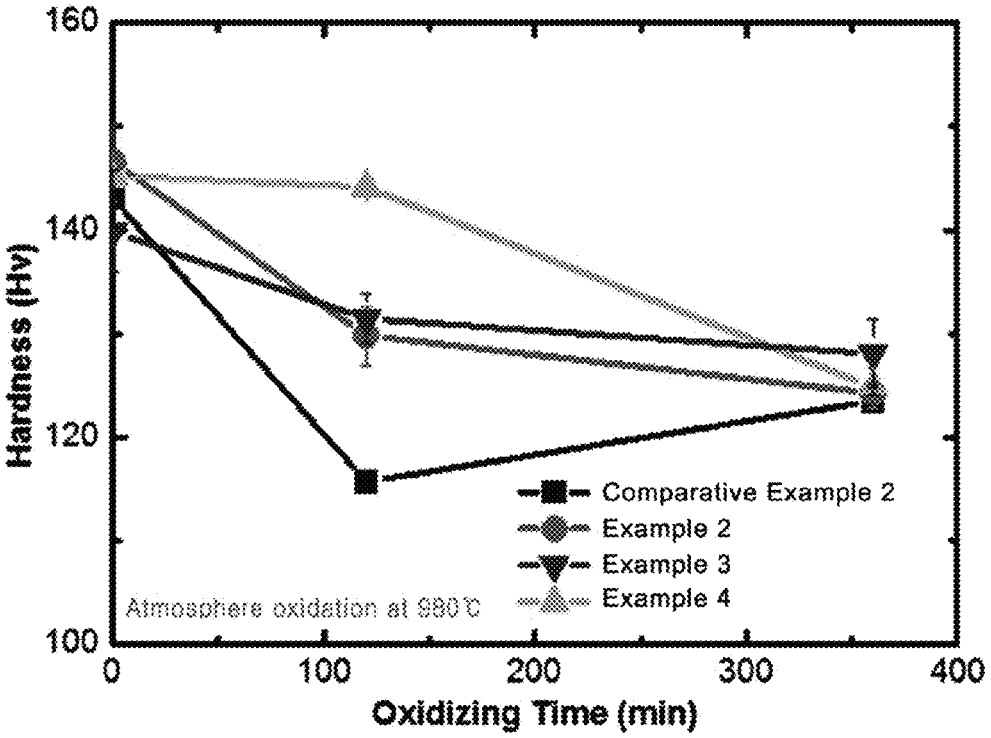
FIGS. 7A and 7B illustrate graphs of hardness and electrical conductivity of the oxide dispersion copper which is prepared according to an embodiment of the present invention.
Figure 7B:
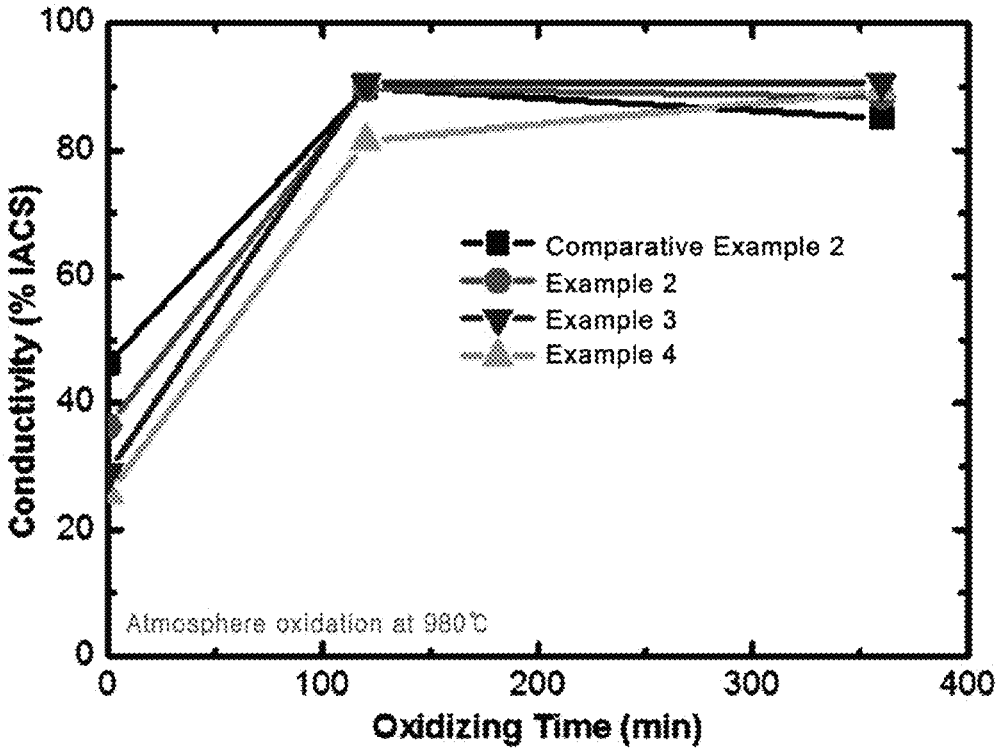

FIG. 7 illustrates graphs of hardness (FIG. 7A) and electrical conductivity (FIG. 7B) of the oxide dispersion coppers which are prepared by the internal oxidation according to Comparative Example 2 and Examples 2-4. As shown in FIG. 7, it is noted that the more weight ratio of titanium is used, the more hardness of the oxide dispersion copper is increased.

Figure 8A:
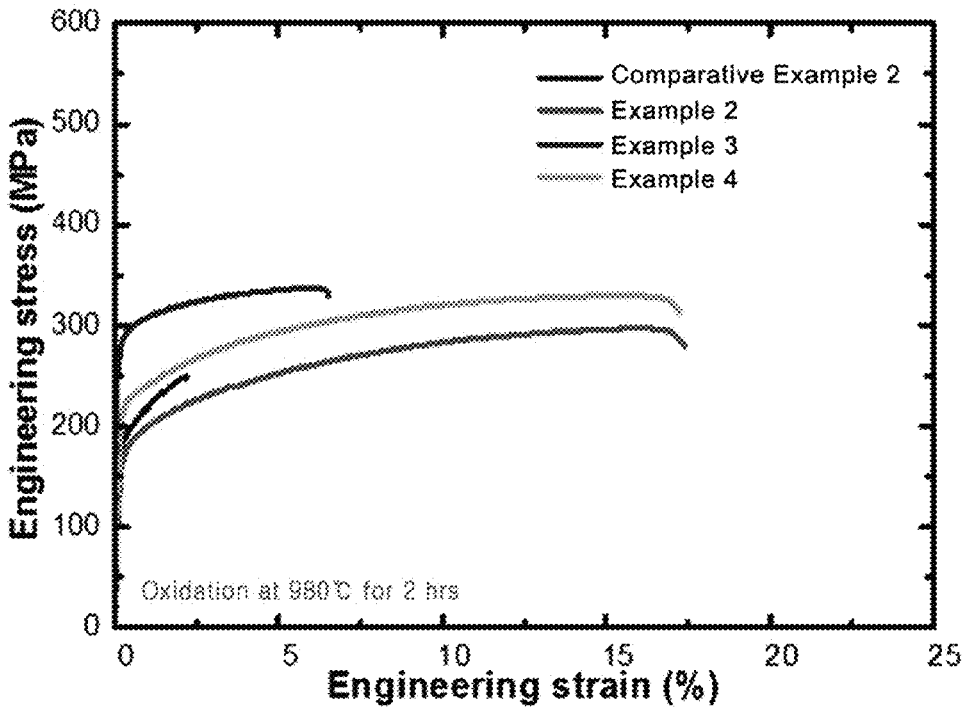
FIGS. 8A and 8B illustrate graphs of tensile strength of the oxide dispersion coppers which are prepared according to embodiments of the present invention.
Figure 8B:
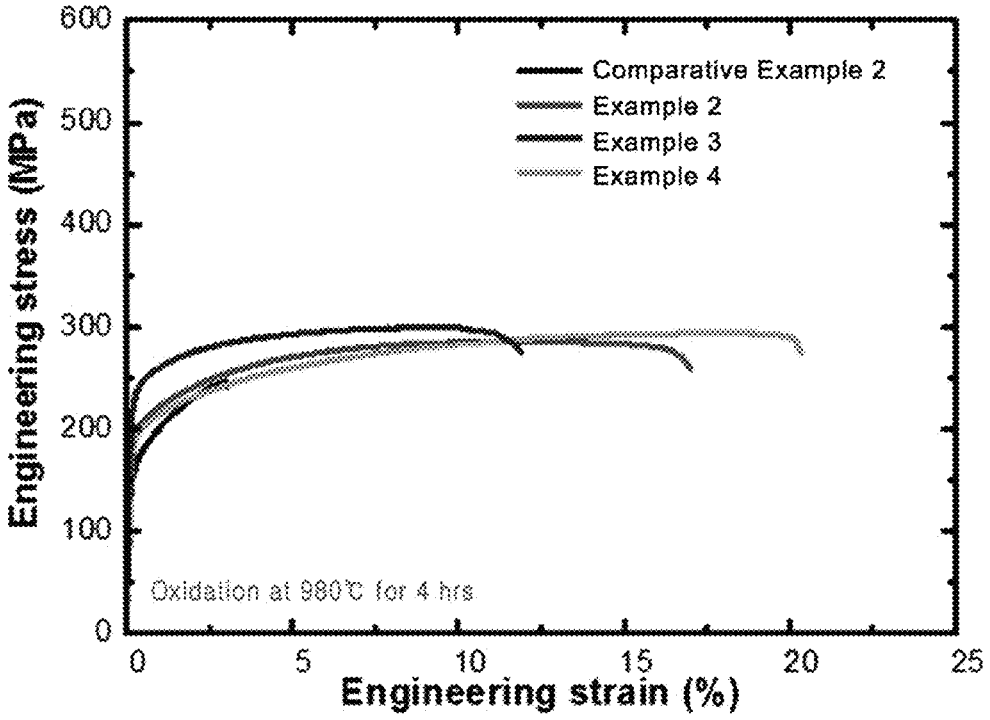

FIG. 8 illustrates graphs of tensile strength and strain to necking of the oxide dispersion coppers which are prepared by the internal oxidation for 2 hours (FIG. 8A) and for 4 hours (FIG. 8B) according to Comparative Example 2 and Examples 2-4. As shown in FIG. 8, it is noted that the more weight ratio of titanium is used, the more tensile strength and strain to necking of the oxide dispersion copper is increased.

As described above, it is clearly noted that due to addition of titanium to the oxide dispersion copper, spheroidization of the oxide, reduction of particle size, and reduction of the distance between particles result in increases of tensile strength and strain to necking.

As shown in FIG. 5 and FIG. 6, the average particle size of the dispersion phase of the oxide dispersion copper prepared in Comparative Example 2 (using the copper-aluminum alloy which does not include titanium) is about 60 nm, while the average particle size of the dispersion phase of the oxide dispersion copper including titanium is 23-32 nm.

Furthermore, the particle shape of the oxide dispersion copper of Comparative Example 2 is relatively more rod or rectangle shape, while the more titanium is used compared to aluminum, the more sphere shape of the oxide dispersion phase is increased (see FIG. 5 and FIG. 6).

Figure 9:
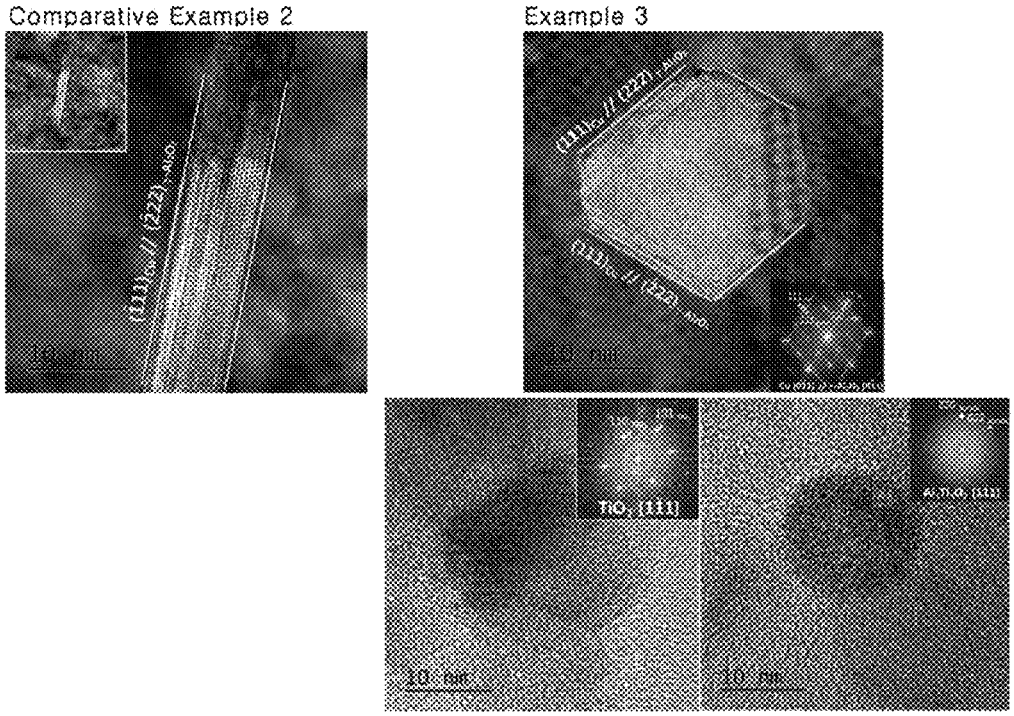
FIG. 9 illustrates TEM images of shape, orientation relationship and composition of the dispersion phase of the oxide dispersion copper which is prepared according to an embodiment of the present invention.

FIG. 9 illustrates TEM images of shape, orientation relationship and composition of the dispersion phase of the oxide dispersion coppers which are prepared in Comparative Example 2 and Example 3. The oxide of Comparative Example 2 has stable orientation relationship of one surface, (111)Cu//(222)$Al_2O_3$, which causes growth of the dispersion phase in one direction to result in a rod shape. On the other hand, the TEM image of shape, composition, and orientation relationship of the dispersion phase of Example 3, unlike Comparative Example 2, shows stable orientation relationship of (111)Cu//(222)$Al_2O_3$, (200)Cu//(400)$Al_2O_3$ surfaces which causes growth of the dispersion phase in various directions to result in a sphere shape.

Furthermore, the density of the dispersion phase of the oxide dispersion copper prepared in Comparative Example 2 (copper-aluminum alloy which does not include titanium) is about $1.75\times10^9/cm^3$, while that of the dispersion phase of the oxide dispersion copper prepared in the present invention is $6.00\times10^9/cm^3$-$1.40\times10^{10}/cm^3$. The density of the dispersion phase of the oxide dispersion copper prepared in the present invention increases with more addition of titanium compared to aluminum.

Experimental Example 3. Analysis of Oxides of the Oxide Dispersion Copper of Comparative Example 2 and Example 3

FIG. 9 illustrates analysis results of the oxide dispersion coppers which are prepared by the internal oxidation in Comparative Example 2 and Example 3. As shown in FIG. 9, it is noted that when the Ti-included copper-aluminum alloy is oxidized, Ti-doped aluminum oxide, $TiO_2$, and $Al_3Ti_5O_2$ oxides are formed.

The more titanium is added to the copper-aluminum alloy, the sphere shape of the dispersion phase of the oxide dispersion copper is increased instead of a rod or rectangle shape. FIG. 5 shows diffraction pattern and TEM image of the Cu—Al alloy of Example 2. When the titanium weight % ratio to aluminum is 0.23, most of the oxide is spheronized.

It is noted that since the oxide dispersion copper prepared in the present invention includes titanium, change in oxide concentration and generation of titanium oxide result in spheronization of the oxide, reduction of particle size and reduction of distance between particles.

Experimental Example 4. Analysis of the Oxide, Electrical and Mechanical Properties of Example 5

Figure 10:
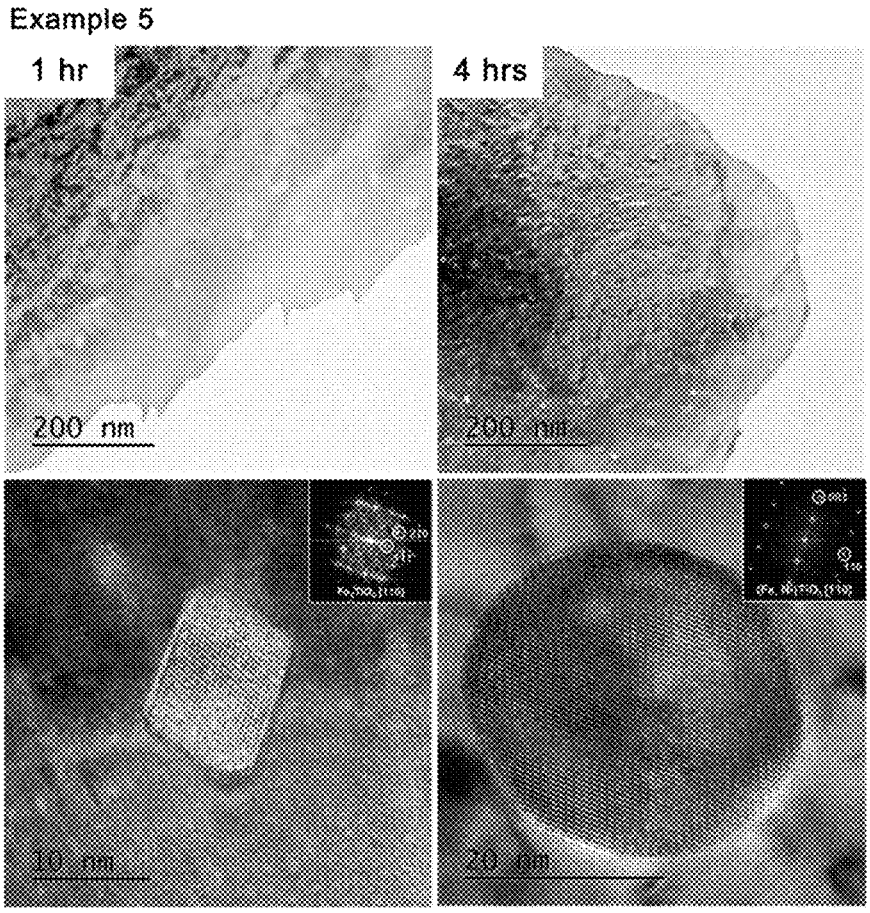
FIG. 10 illustrates TEM images of shape, orientation relationship and composition of the dispersion phase of the oxide dispersion copper which is prepared according to an embodiment of the present invention.

FIG. 10 illustrates TEM images of the oxide of the oxide dispersion copper which is prepared by the internal oxidation according to Example 5. As shown in FIG. 10, it is noted that when Ti-included copper-nickel-iron alloy is oxidized, Ti-doped iron oxide, nickel and iron-included titanium oxides are formed.

FIG. 10 illustrates TEM images of shape, orientation relationship and composition of the dispersion phase of the oxide dispersion copper which is prepared in Example 5 after the internal oxidation. The oxide has (Fe, Ni)$TiO_3$ and $Fe_2$(Ti, Ni)$O_4$ composition and has sphere and rectangle shapes.

Figure 11:
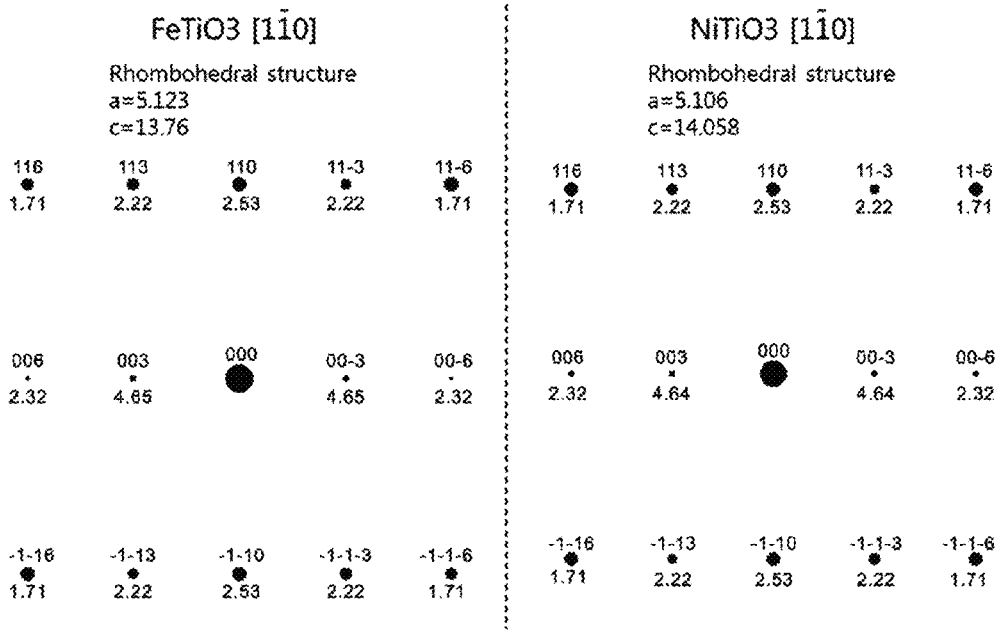
FIG. 11 illustrates rhombohedral structure of the oxide which can be prepared according to an embodiment of the present invention.

FIG. 11 illustrates rhombohedral structure of $FeTiO_3$ and $NiTiO_3$ and is an evidence that Fe and Ni generates the same oxide as Ti does.

Figure 12A:
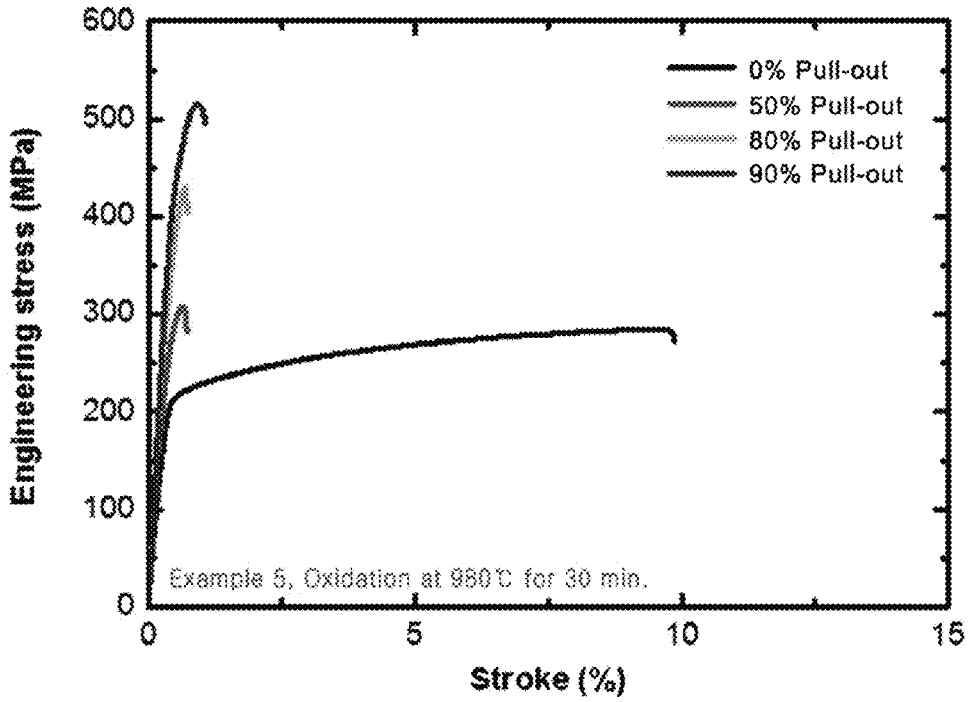
FIGS. 12A and 12B illustrate graphs of tensile strength and electrical conductivity of the oxide dispersion copper which is prepared according to an embodiment of the present invention.
Figure 12B:
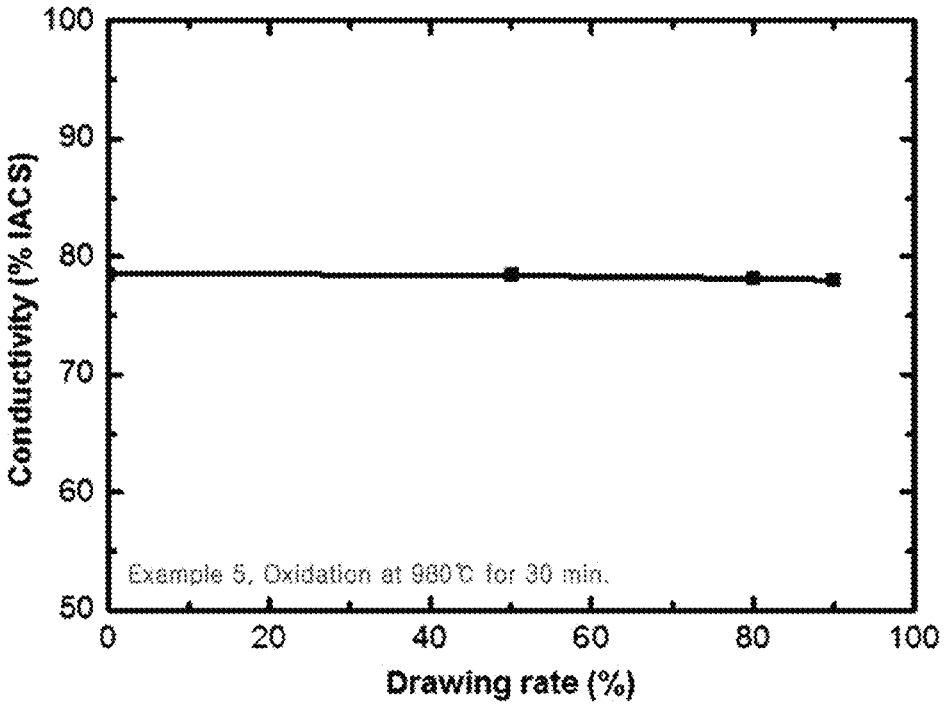

FIG. 12 illustrates graphs of tensile strength (FIG. 12A) and electrical conductivity (FIG. 12B) of the oxide dispersion copper which is prepared by the internal oxidation according to Example 5. It is noted that the oxide including titanium improves mechanical properties of the dispersion copper.

Experimental Example 5. Analysis of Hardness, Electrical Conductivity, and Mechanical Properties of the Oxide Dispersion Copper of Examples 2-5

Figure 13:
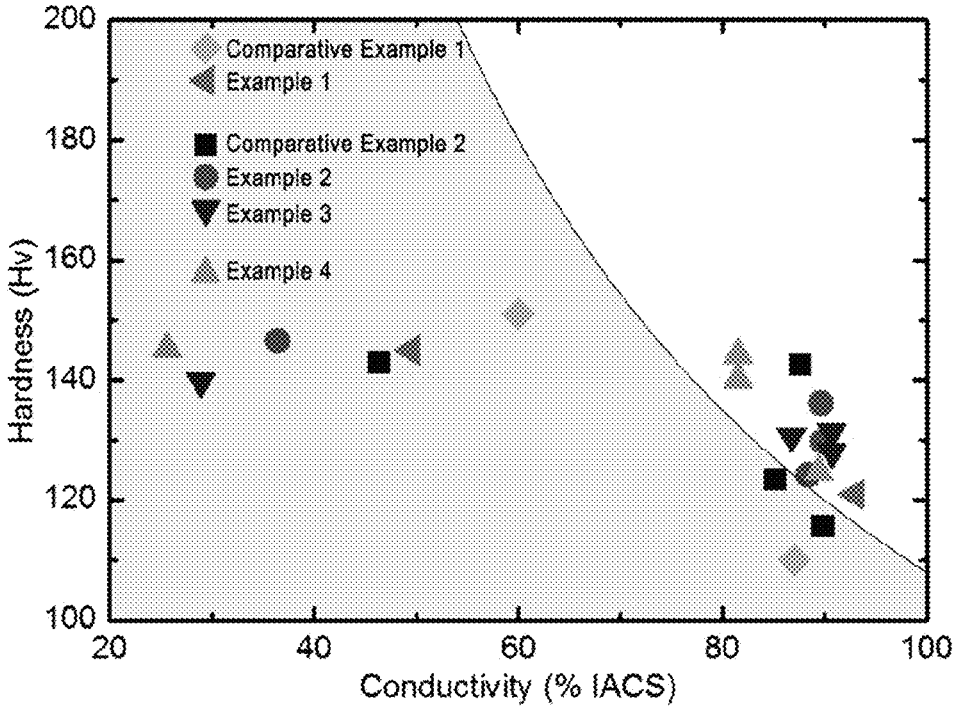
FIG. 13 illustrates a graph of hardness vs electrical conductivity of the oxide dispersion copper which is prepared according to an embodiment of the present invention.

FIG. 13 illustrates a graph of hardness vs electrical conductivity of the oxide dispersion copper of Examples 2-4. It is noted that multiplied values of hardness and electrical conductivity of Examples 2-4 is higher than those shown in Comparative Examples 1 and 2.

Figure 14:
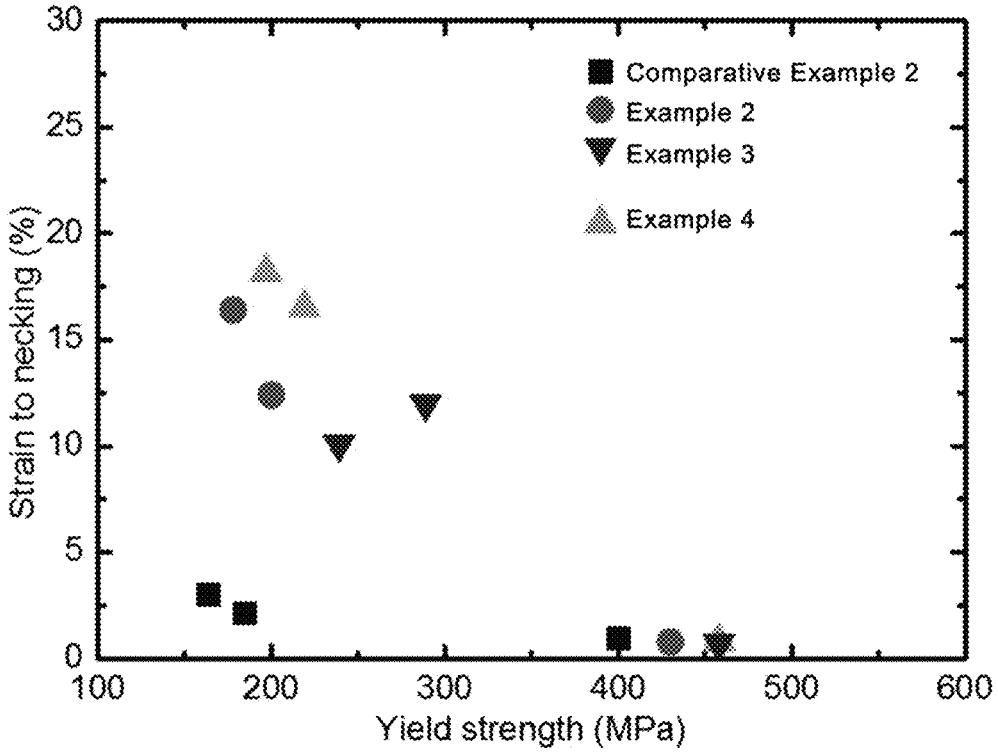
FIG. 14 illustrates a graph of yield strength vs strain to necking of the oxide dispersion copper which is prepared according to an embodiment of the present invention.

FIG. 14 illustrates a graph of yield strength vs strain to necking of the oxide dispersion copper of Examples 2-4. It is noted that multiplied values of yield strength and strain to necking of Examples 2-4 is higher than those shown in Comparative Examples 1 and 2.

FIG. 13 and FIG. 14 prove that the dispersion copper including titanium-included oxide improves mechanical properties due to spheroidization of the oxide, reduction of particle size and reduction of distance between particles.

Figure 15:
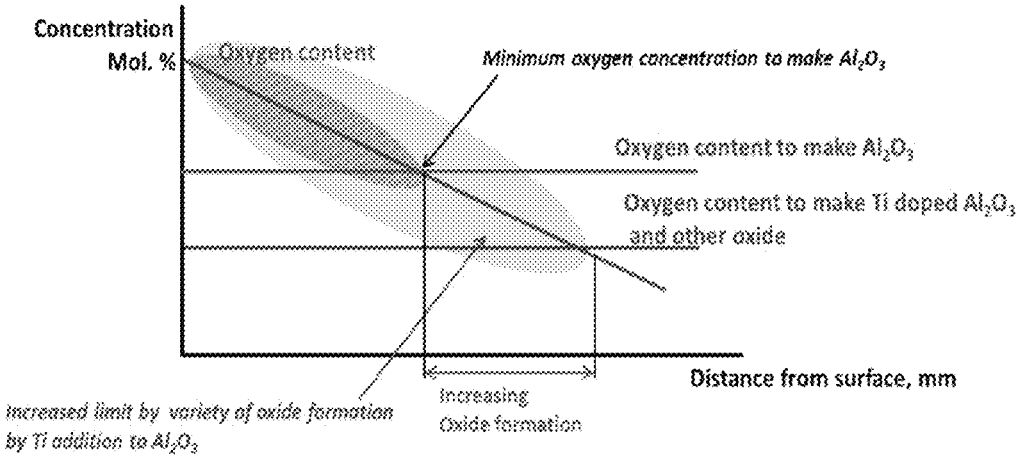
FIG. 15 is a schematic mechanism illustrating spheroidization, reduction in particle size, and reduction in distance between particles of the oxide with addition of titanium according to the present invention.

FIG. 15 is a schematic mechanism illustrating spheroidization, reduction in particle size, and reduction in distance between particles of the oxide with addition of titanium in Examples 2-5, compared to Comparative Examples 1 and 2. According to FIG. 15, the dispersion phase, in which titanium is added in Examples 2-5, are various dispersion phase of $Al_2O_3$, $TiO_2$, $Al_3Ti_5O_2$, $Fe_2TiO_4$, $FeTiO_3$, $NiTiO_3$, and (Fe,Ni)$TiO_3$. Thus, the oxygen diffused inside the alloy during the internal oxidation reacts with aluminum and titanium at the same time to have various stoichiometries and form various dispersion phases due to Ni, Fe and Al included in the alloy. As shown in FIG. 15, it shows that the oxide can be formed with a small amount of oxygen, a particle size can be reduced and distance between particles can be decreased.

The copper-aluminum alloy including titanium of Examples 1-4 prevents excessive growth of one oxide by forming oxides of aluminum and titanium in various stoichiometries and allows spheroidization of the oxide by forming various surfaces through doping titanium on the aluminum. It is also shown in FIG. 5 that nickel, iron and titanium are oxidized during the internal oxidation to form various dispersion phases having a sphere shape. As such, various dispersion coppers including composite oxide such as copper-aluminum-titanium, copper-iron-nickel alloy can be manufactured by using combined addition of transition metals such as nickel, chromium, vanadium, zirconium, manganese, cobalt, zinc, iridium, molybdenum and the like which can be easily oxidized as well as aluminum and titanium.

The spirit of the present invention has been described by way of example hereinabove, and the present invention may be variously modified, altered, and substituted by those skilled in the art to which the present invention pertains without departing from essential features of the present invention. Accordingly, the exemplary embodiments disclosed in the present invention and the accompanying drawings do not limit but describe the spirit of the present invention, and the scope of the present invention is not limited by the exemplary embodiments and accompanying drawings. The scope of the present invention should be interpreted by the following claims and it should be interpreted that all spirits equivalent to the following claims fall within the scope of the present invention.

What is claimed is:

1. Oxide dispersion copper wherein at least one metal oxide selected from the group consisting of Ti-doped aluminum oxide, aluminum titanium oxide, iron titanium oxide, nickel titanium oxide and iron nickel titanium oxide is dispersed in copper or copper alloy.

2. The oxide dispersion copper of claim 1, wherein the metal oxide comprises at least one metal oxide selected from the group consisting of Ti-included $Al_2O_3$, $Al_3Ti_5O_2$, $TiO_2$, $Fe_2TiO_4$, $FeTiO_3$, $NiTiO_3$, and (Fe, Ni)$TiO_3$.

3. The oxide dispersion copper of claim 1, wherein the dispersion copper is in the form of plate, wire, or powder.

4. An electrode material, a wear-resistant coating layer, or a small wear-resistant material prepared by using the oxide dispersion copper of claim 1.

5. Oxide dispersion copper, wherein a metal oxide, prepared, by oxidizing a copper alloy through oxygen diffusion and oxidation, is dispersed, wherein the copper alloy is a Ti-included copper alloy comprising at least one metal selected from the group consisting of aluminum, nickel, iron, chromium, vanadium, zirconium, manganese, cobalt, zinc, iridium, molybdenum, and an alloy thereof which forms a metal oxide selected from the group consisting of Ti-doped aluminum oxide, aluminum titanium oxide, iron titanium oxide, nickel titanium oxide, and iron nickel titanium oxide in copper or copper alloy to prepare an oxide dispersion strengthened copper alloy by oxidation.

6. The oxide dispersion copper of claim 5, wherein the metal oxide comprises at least one metal oxide selected from the group consisting of Ti-included $Al_2O_3$, $Al_3Ti_5O_2$, $TiO_2$, $Fe_2TiO_4$, $FeTiO_3$, $NiTiO_3$, and (Fe, Ni)$TiO_3$.

7. The oxide dispersion copper of claim 6, the metal oxide comprises $TiO_2$.

8. The oxide dispersion copper of claim 5, wherein an average particle size of the dispersion phase of the oxide dispersion copper is 35 nm or less.

9. An electrode material, a wear-resistant coating layer, or a small wear-resistant material prepared by using the oxide dispersion copper of claim 5.

10. A method for preparing oxide dispersion copper comprising:

casting a Ti-included copper alloy comprising at least one metal selected from the group consisting of aluminum, nickel, iron, chromium, vanadium, zirconium, manganese, cobalt, zinc, iridium, molybdenum, and an alloy thereof; and oxidizing the Ti-included copper alloy by reacting with oxygen under oxygen supply to form within the Ti-included copper alloy a dispersed metal oxide selected from the group consisting of Ti-doped aluminum oxide, aluminum titanium oxide, iron titanium oxide, nickel titanium oxide, and iron nickel titanium oxide.

11. A $Cu_2O$ oxidizing agent derived from an oxidation layer eliminated from the surface of an oxide dispersion copper which is oxidation-treated by the method of claim 10 and comprising at least one selected from the group consisting of Al, Ti, Ni and Fe.

12. The method of claim 10, wherein the oxygen supply is carried by atmospheric pressure, oxygen atmosphere, or an oxidizing agent.

13. The method of claim 10, wherein the method for preparing oxide dispersion copper comprises heat treatment or plastic deformation.

* * * * *